US007241171B2

(12) United States Patent
Herzog

(10) Patent No.: US 7,241,171 B2
(45) Date of Patent: Jul. 10, 2007

(54) ELECTRICAL COMPONENT ASSEMBLY

(75) Inventor: Richard R. Herzog, Arlington Heights, IL (US)

(73) Assignee: Illinois Tool Works Inc, Glenview, IL (US)

( * ) Notice: Subject to any disclaimer, the term of this patent is extended or adjusted under 35 U.S.C. 154(b) by 0 days.

(21) Appl. No.: 11/080,582

(22) Filed: Mar. 15, 2005

(65) Prior Publication Data

US 2005/0215116 A1 Sep. 29, 2005

Related U.S. Application Data

(60) Provisional application No. 60/555,924, filed on Mar. 24, 2004.

(51) Int. Cl.
*H01R 13/73* (2006.01)

(52) U.S. Cl. ..... 439/547; 439/918

(58) Field of Classification Search ..... 439/357, 439/533, 546, 547, 549, 558, 559, 617, 618, 439/682, 683, 936, 953
See application file for complete search history.

(56) References Cited

U.S. PATENT DOCUMENTS 4,100,448 A * 7/1978 Chipner et al. ..... 313/318.11
4,804,343 A * 2/1989 Reedy ..... 439/854
5,087,213 A * 2/1992 Drapcho et al. ..... 439/672
5,176,532 A 1/1993 Herzog et al.
5,241,746 A 9/1993 Herzog et al.
5,407,363 A * 4/1995 Polgar et al. ..... 439/546
5,501,609 A 3/1996 Watanabe
5,989,067 A * 11/1999 Morgan et al. ..... 439/617
6,439,899 B1 8/2002 Muzslay et al.
6,450,834 B1 * 9/2002 Polgar et al. ..... 439/546

FOREIGN PATENT DOCUMENTS

DE 1165124 B 3/1964
EP 0655803 A 6/1998
FR 2 734 086 A 8/1996
FR 2844106 A 3/2004

* cited by examiner

*Primary Examiner*—Thanh-Tam Le
(74) *Attorney, Agent, or Firm*—Mark W. Croll; Paul F. Donovan

(57) ABSTRACT

An electrical assembly for mounting an electrical device, such as a lamp socket, in an appliance has first and second components on opposite sides of a wall of the appliance. The first component is attached to the wall and closes a hole through the wall on a first side thereof. The second component is attached to the first component and closes the hole on an opposite side of the wall. Complementary quick connect electrical terminals are provided in the first and second components whereby electrical connection is established as the first and second components are attached one to the other.

12 Claims, 5 Drawing Sheets

ELECTRICAL COMPONENT ASSEMBLY

CROSS-REFERENCE TO RELATED APPLICATIONS

The present regular U.S. patent application claims the benefits of U.S. Provisional Application Ser. No. 60/555,924 filed Mar. 24, 2004.

FIELD OF THE INVENTION

The present invention relates generally to light sockets and receptacle assemblies. More particularly, the present invention relates to electrical assemblies used in appliances, such as refrigerators and the like, providing electrical components in the enclosed interior compartments.

BACKGROUND OF THE INVENTION

It is known for appliances, such as refrigerators and freezers, to have lights, switches, controls and other electrical components exposed or operating within the interior compartment of the appliance. Electrical devices such as these require electrical connection to the electrical system of the appliance. Connection is made through a wall, with the electrical device provided on one side of the wall, and wire conductors from the electrical system on the other side of the wall.

Foam insulation is used in the walls of appliances such as refrigerators and freezers for thermal efficiency, sound deadening and the like. For maximum effectiveness, the foam insulation should be substantially continuous with minimal breaks, interruptions, voids or excessive spacing around openings, such as electrical component installations. During the foam insulation process, it is important that any openings to the interior compartment of the appliance be sealed so that the foam insulation does not enter the interior compartment. Due to the nature of the foaming process, the accepted procedure has been to assemble and install such components after the foaming process is complete.

A known design for interior lights in refrigerators includes two light sockets mounted to a plastic housing such that the sockets are in a slightly downward direction and oppositely directed with respect to each other, spaced about four inches apart. The light sockets are wired together with a wire assembly that terminates with a single two-conductor connector. The housing, two light sockets and wire assembly are preassembled and thereafter mounted to the back wall, typically a plastic back wall of the refrigerator. Tabs in the housing mate with holes in slots of the back wall to secure the assembly to the back wall of the refrigerator. The housing includes a tab and slot adapted to line up with a hole in an anchor, preferably a metal anchor, that is adhesively attached or secured to the back wall of the refrigerator and that is also adapted to accept a screw. The area in the back wall beneath the housing has a self-adhesive foil to act as a heat shield. A strip of self-adhesive foam tape is placed on the back wall directly under the edge of the housing to prevent water and other liquids and contaminants from entering the housing and coming into contact with the wires within the housing. The back wall includes an oval-shaped opening adapted to receive a rubber grommet that is molded to the wires. The grommet acts as a seal for the back wall, to prevent moisture from infiltrating the wall cavity. Two wires from a wire harness are passed through the oval hole and the wires are terminated with a two-prong connector to mate with the connector within the housing assembly compartment.

While known assemblies of the type described have proven useful in the past, known assemblies are relatively complex to manufacture and assemble, and costs associated with the manufacture and assembly are relatively high. Further, the assemblies are bulky, occupying significant space within the interior compartment, thereby reducing available space for food storage.

What is needed is a simplified, compact structure for mounting light sockets, switches or other electrical components in the walls of appliances and which is easy to install.

SUMMARY OF THE INVENTION

The present invention provides an electrical component assembly for mounting in an appliance wall, which includes interlocking interior and exterior components, each carrying mating electrical terminals. The components engage opposite sides of the wall to prevent insulation foam from migrating into the interior compartment and to prevent moisture from infiltrating into the foam or exterior surfaces. Moisture conducting structures are provided on the interior component to funnel moisture away electrical contacts.

In one aspect thereof, the present invention provides an assembly for holding an electrical component in a wall having a hole. The assembly includes a first component configured for attachment to the wall, on one side of the wall. A peripheral skirt surrounds the first component for engaging the wall and covering the hole on one side of the wall. A boss in the first component receives an electrical terminal. The boss is open to an opposite side of the wall. A second component includes a base configured for attachment to the first component and for holding a complementary electrical terminal for electrically coupling with the first mentioned terminal. A second component skirt engages the wall on a side opposite the side engaged by the skirt of the first component.

In another aspect thereof, the present invention provides an electrical component assembly for an appliance having a wall defining a hole. The assembly has a first component structured to attach to the wall and to cover the hole from one side of the wall. A second component is structured to attach to the first component and to cover the hole from a second side of the wall. The first and second components have complementary fixed position electrical terminals that plug one into the other as the second component is attached to the first component.

In still another aspect thereof, the present invention provides a method for installing an electrical device in an appliance wall defining a hole. The method steps include inserting a first component into the hole from one side of the wall, attaching the first component to the wall and positioning an electrical wire having a terminal thereon in substantially fixed position relative to the first component. The method also includes obtaining a second component having the electrical device therein and a substantially fixed position electrical terminal electrically connected to the device. The installation method further includes attaching the second component to the first component from an opposite side of the wall and plugging one terminal into the other the terminal simultaneously with the step of attaching the second component to the first component.

An advantage of the present invention is providing a compact electrical component assembly for use in appliances, thereby reducing the space required for the assembly in the interior of the appliance and increasing usable space within the appliance.

Another advantage of the present invention is providing an electrical component assembly that is easy to install in appliance walls.

Still another advantage of the present invention is providing an electrical component assembly for appliances in which a wire harness can be assembled together with an exterior component to close the hole entering the compartment prior to insulating the wall, and in which the interior component of the assembly is attached during final assembly of the appliance interior.

Other features and advantages of the invention will become apparent to those skilled in the art upon review of the following detailed description, claims and drawings in which like numerals are used to designate like features.

Figure 1:
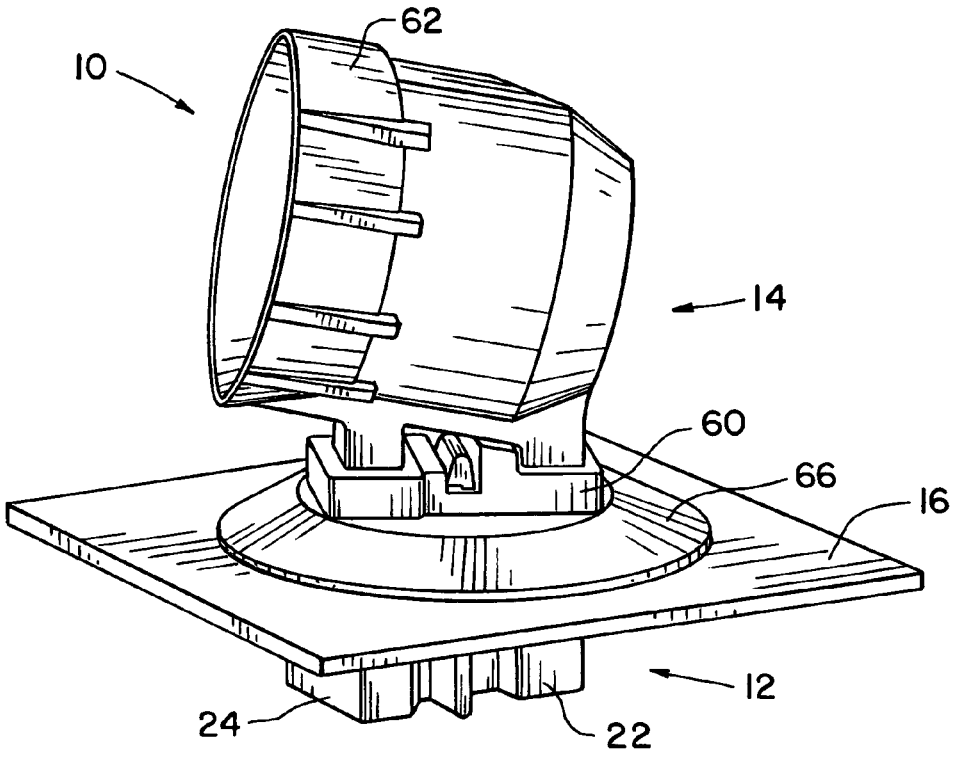
FIG. 1 is a perspective view of an electrical component assembly in accordance with the present invention.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now more specifically to the drawings and to FIG. 1 in particular, numeral 10 designates an electrical component assembly in accordance with the present invention. Assembly 10 includes a first or exterior component 12 and a second or interior component 14 mounted on opposite sides of a wall 16 of the appliance. While referred to in the description to follow as being exterior and interior components 12 and 14, it should be understood that components 12 and 14 can be used on other than an exterior wall of an appliance. Accordingly, exterior component 12 and interior component 14 can simply be first and second components respectively of an assembly 10 in which components 12 and 14 are provided on opposite sides of wall 16 that separates interior appliance compartments. Exterior component 12 can be disposed within a wall structure cavity, between wall 16 as an interior wall panel and a spaced exterior panel (not shown). Further, the present invention can be used advantageously on structures other than appliances.

Figure 2:
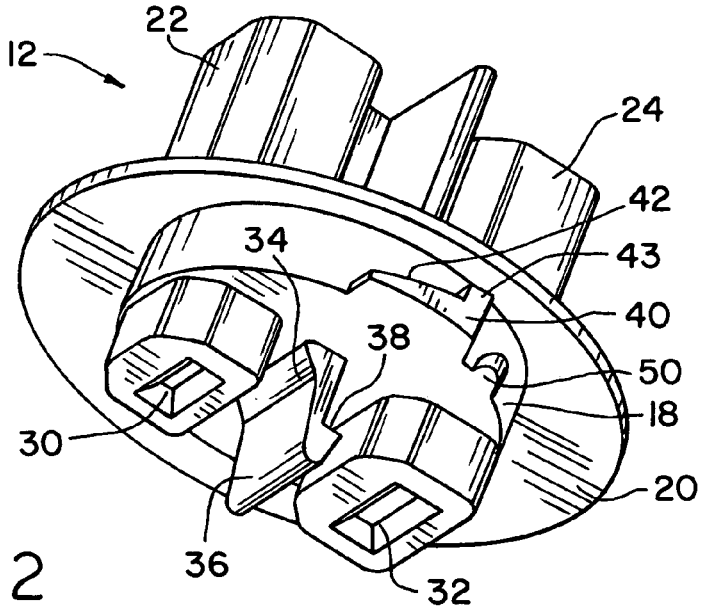
FIG. 2 is a perspective view of the exterior component of the assembly shown in FIG. 1.
Figure 3:
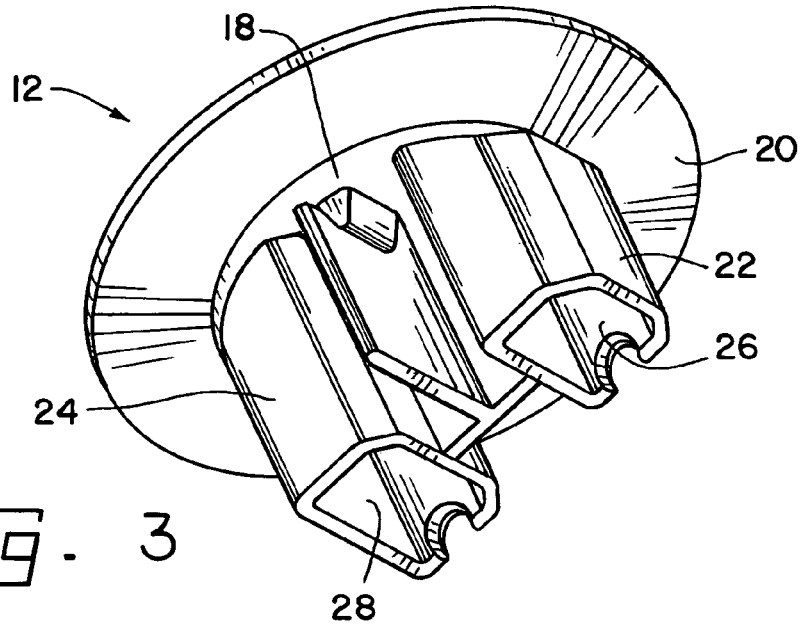
FIG. 3 is a perspective view of the component shown in FIG. 2, illustrating the component from a different perspective.

First or exterior component 12 is shown more clearly in FIGS. 2 and 3. Exterior component 12 is configured for attaching assembly 10 to wall 16 and for establishing electrical connection between electrical components of interior component 14 and the wiring system of the appliance.

Exterior component 12 includes a central body 18 and a peripheral skirt 20. Central body 18 defines first and second terminal bosses 22, 24 having rearward facing openings 26, 28 and forward facing openings 30, 32, respectively. The terms "rearward" and "forward" are used with reference to the direction of interior component 14 relative to exterior component 12, with "forward" meaning the direction toward or confronting the other component, and "rearward" meaning the direction away from the other component. Those skilled in the art will understand readily that wall 16 need not be a vertical or side wall, but can also be a horizontal panel such as a top or bottom. Accordingly, any terms used herein implying direction or orientation are used only for purposes of clarity in description relative to the views shown in the drawings, and the relationships of the associated components, as illustrated. Such terms should not be considered as limiting on the use or application of the present invention.

Rearward facing openings 26, 28 are configured for receiving wire ends and terminals of a wire harness for providing electrical current to assembly 10. Forward facing openings 30, 32 of central body 18 are sized and configured for receiving terminals from interior component 14, as will be described in greater detail hereinafter.

Between terminal bosses 22 and 24 on the forward or inwardly directed side of exterior component 12, a latch 34 is provided for engaging interior component 14, as will be described in greater detail hereinafter. Latch 34 is a substantially hook-like structure having a post 36 and a distal lip 38.

Central body 18 includes one or more generally radial outwardly directed tab 40 having a ramp surface 42 and a stop 43. Tab or tabs 40 are disposed in spaced relation to skirt 20, and in the installed condition of component 12, tab or tabs 40 are disposed on an opposite side of wall 16 from peripheral skirt 20. In a preferred structure of exterior component 12, two tabs 40 are provided substantially on opposite sides of central body 18. It should be understood however that a single tab 40 can be used, and more than two tabs 40 also may be used.

Figure 6:
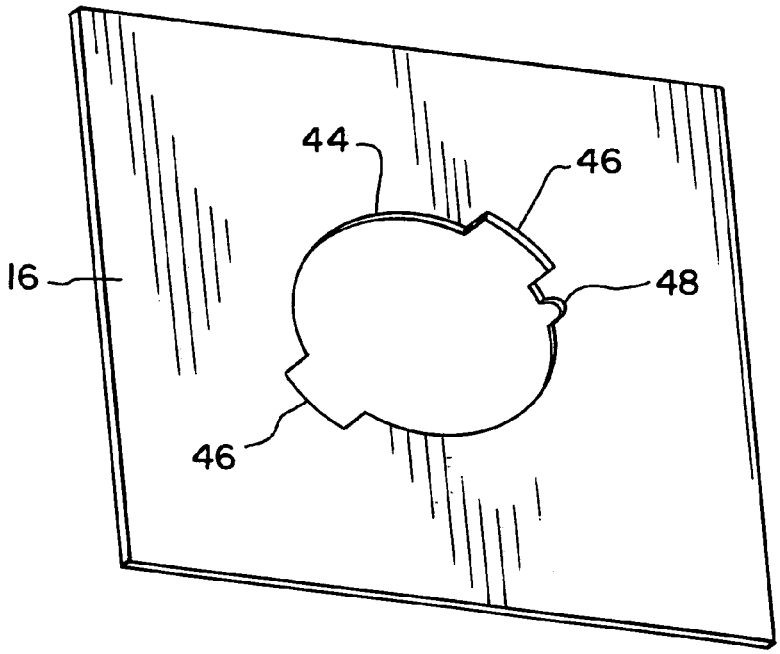
FIG. 6 is a perspective view of a portion of an appliance wall in which the electrical component assembly of FIG. 1 may be installed.

As illustrated in FIG. 6, wall 16 defines a hole 44 for receiving the forwardly or inwardly projecting end portion of central body 18. Wall 16 further defines oppositely directed lateral cutouts 46 sized and positioned for receiving tabs 40 therein. Thus, one cutout 46 is provided for each tab 40 and positioned relative to hole 44 so tab or tabs 40 can project therethrough. To ensure the proper orientation of exterior component 12 relative to wall 16, a notch 48 is provided in the periphery of hole 44 and a key protuberance 50 is defined in central body 18. Thus, with tabs 40 provided on opposite sides of body 18, misalignment is prevented in that exterior component 12 can be aligned with wall 16 in only one orientation such that key protuberance 50 will extend through notch 48. Each cutout 46 is delineated by opposed edges 52, 54 defining a width of cutout 46 selected to cooperate with tab 40 and protuberance 50 to lock exterior component 12 to wall 16, as will be described in more detail hereinafter.

Peripheral skirt 20 is a strong, yet somewhat flexible or pliable dome-shaped body. During installation, with the interior-facing end portion of central body 18 projecting through wall 16, and with tabs 40 aligned in cutouts 46, exterior component 12 is rotated slightly. An interior surface of wall 16 thereby slides along ramp 42, drawing peripheral skirt 20 more tightly against wall 16. Peripheral skirt 20 covers hole 44 and cutouts 46 relatively tightly as skirt 20 is drawn against wall 16. Thus, if foam insulation or the like is injected into a space defined by wall 18, the foam cannot readily migrate through hole 44 to an interior space of the appliance since peripheral skirt 20 of exterior component 12 substantially closes hole 44.

Figure 4:
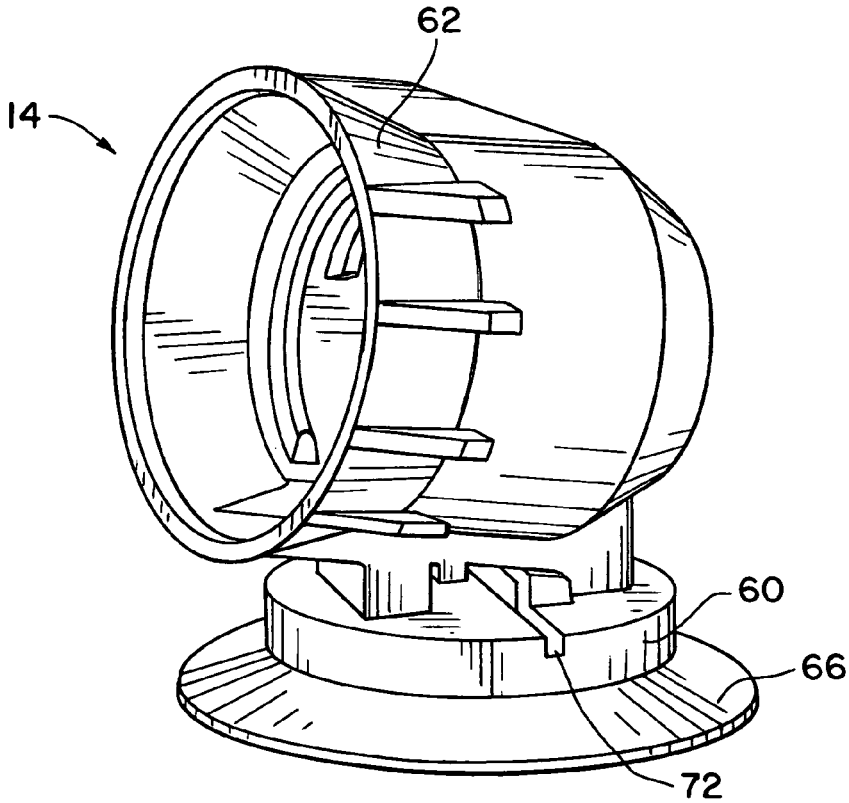
FIG. 4 is a perspective view of the interior component of the electrical component assembly shown in FIG. 1.
Figure 5:
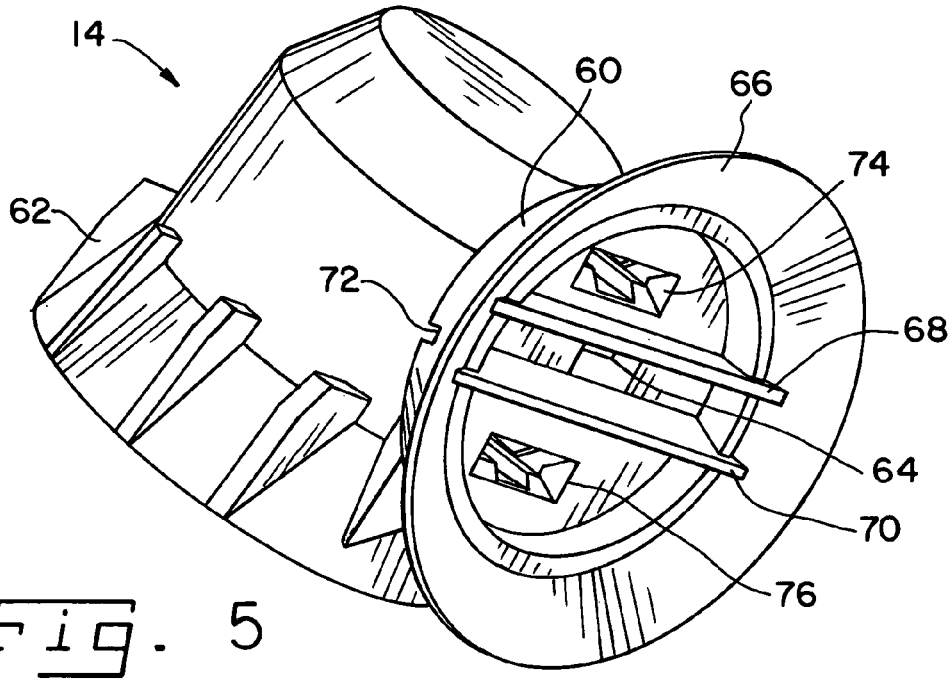
FIG. 5 is a perspective view of the interior component shown in FIG. 4, but illustrating the interior component from a different perspective.

Interior component 14 is shown more clearly in FIGS. 4 and 5. In the exemplary embodiment, interior component 14 includes a base structure 60 and a lamp socket 62. Base 60 is designed for attachment to exterior component 12 as will be described more fully hereinafter. Lamp socket 62 is provided for receiving a bulb therein for illuminating the interior of the appliance in which assembly 10 is installed. While illustrated for a light, it should be understood that lamp socket 62 is only one configuration of an electrical device suitable for use with the present invention. Thus, instead of lamp socket 62, interior component 14 could include a switch or other electrical device requiring connection through wall 16. The present invention should not be considered as limited to only a lamp socket as shown, lamp socket 62 being merely one suitable device for use with the present invention.

Base 60 is a dome shaped structure having a central aperture 64 through which latch 34 extends. Lip 38 is tapered at its distal end. As exterior component 12 and interior component 14 are forced together, post 36 deflects laterally as lip 38 is pushed through aperture 64. When lip 38 has cleared aperture 64, post 36 rebounds such that lip 38 overlaps a portion of base 60 adjacent and defining aperture 64. In this way, interior component 14 is secured to exterior component 12.

Base 60 further includes a skirt 66 about the periphery thereof. Skirt 66 is similar to skirt 20, being made of resilient, yet thin flexible material. Base 60 is configured such that skirt 66 is compressed and deflects as interior component 14 is secured to exterior component 12. Skirt 66 thereby engages an interior surface of wall 16 similarly to the engagement of exterior skirt 20 against an exterior surface of wall 16. Skirt 66 provides a substantially moisture proof seal against wall 16 so that moisture, condensation and the like forming on the interior surface of wall 16 cannot migrate easily behind skirt 66 and into hole 44. Some moisture may accumulate on inner surfaces of base 60 in that aperture 64 provides a path for humid air to flow behind base 60. Baffles 68, 70 are provided on opposite sides of aperture 64 to channel moisture toward a weep hole 72.

Base 60 further defines terminal slots 74, 76 that align with forward openings 30, 32 in terminal bosses 22, 24 of exterior component 12. Terminal slots 74, 76 are disposed outwardly of baffles 68, 70 relative to aperture 74 such that moisture entering aperture 74 is deflected by baffles 68, 70 away from terminal slots 74, 76 and any terminals therein.

Figure 7:
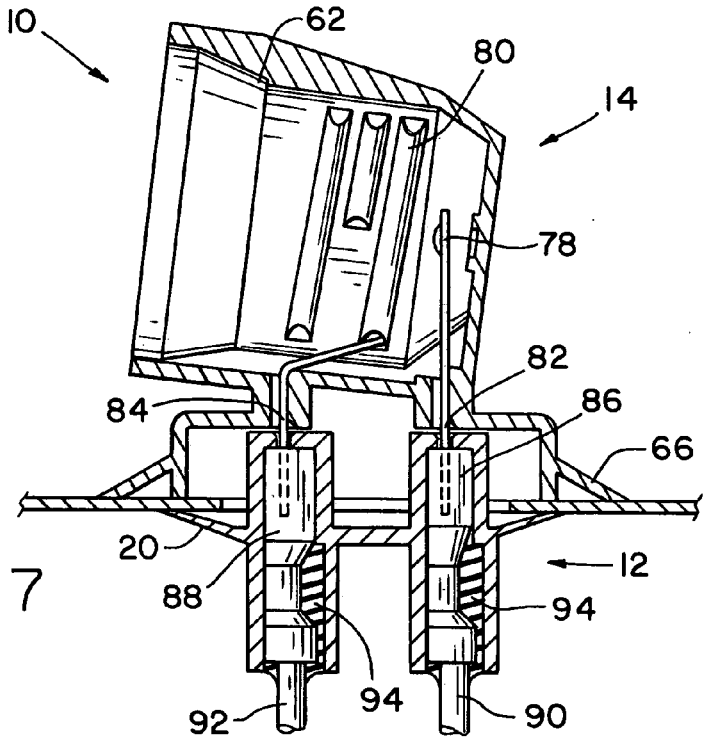
FIG. 7 is a cross-sectional view of the assembly shown in FIG. 1, with electrical conductors, terminals and wires installed.

Lamp socket 62 is of known construction for receiving a lamp therein. With reference to FIG. 7, electrical conductors 78, 80 of socket 62 are electrically connected to male quick connect terminals 82, 84 projecting through terminal slots 74, 76 and into complimentary female quick connect terminals 86, 88 held in terminal bosses 22, 24. Thus, when interior component 14 is brought into engagement with exterior component 12, electrical connection is established between wires 90, 92 leading into terminal bosses 22, 24 and a bulb fitted into lamp socket 62. The male and female quick connect terminals 82, 84 and 86, 88, respectively are in substantially fixed positions within interior component 14 and exterior component 12, allowing male terminals 82, 84 to plug into female terminals 86 88 as interior component 14 is attached to exterior component 12.

In use of the present invention, exterior component 12 can be shipped to a manufacturing facility forming the shell of the appliance and fitting the electrical harnesses and system thereto. Wires 90, 92 having female quick connect terminals 86, 88 thereon are inserted into bosses 22, 24. To seal the ends of terminal bosses 22, 24, potting material 94 in the nature of an electrically insulative resin is flowed into terminal bosses 22, 24 after wires 90, 92 have been inserted therein. A moisture proof and permanent fixation of wires 90, 92 and terminal bosses 22, 24 is thereby provided.

Exterior component 12 is attached to wall 16 as described previously, with tab or tabs 40 aligned with cutouts 46, and with notch 48 aligned with key protuberance 50. Exterior component 12 is rotated slightly after it is inserted into hole 44, such that ramps 42 slide along wall 16, drawing exterior component 12 tightly against wall 16 and deflecting skirt 20 to establish a moisture resistant engagement of exterior component 12 against wall 16 on one side. With hole 44 closed thereby, the interior wall cavity including wall 16 can be filled with foam insulation as necessary, and the foam insulation is blocked from migrating to the interior side of wall 16 by exterior component 12 sealed within hole 44.

During attachment, exterior component 12 is rotated until stop 43 engages edge 52, inhibiting further rotation in that direction. The relative positions of stop 43 and key protuberance 50 relative to the width of cutout 46 are selected so that with stop 43 engaged against edge 52, protuberance 50 is disposed in cutout 46, near edge 54. As a result, exterior component 12 is locked in place with rotation in one direction inhibited by stop 43 against edge 52, and rotation in the opposite direction inhibited by protuberance 50 against edge 54.

Advantageously, interior component 14 can be shipped to a different facility or area of an assembly plant in which the interior structure of the appliance is completed. When the shell is received with exterior component 12 already installed therein, interior structures are installed, including interior component 14. Male quick connect terminals 82, 84 extending through terminal slots 74, 76 are aligned with terminal bosses 22, 24 and female quick connect terminals 86, 88 therein. As interior component 14 is brought into engagement with and is attached to exterior component 12, male quick connect terminals 82, 84 engage female quick connect terminals 86, 88 in exterior component 12. Latch 34 forcibly engages interior component 14, deflecting skirt 66 against wall 16. In a compact structure, electrical connection is established between wires 90, 92 and lamp socket 62. The electrical connection is established simultaneously with the attachment of second component 14 to first component 12.

Figure 8:
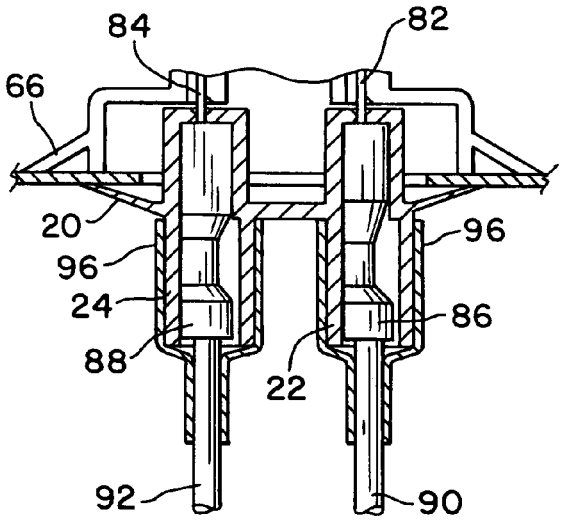
FIG. 8 is a fragmentary cross-sectional view similar to that of FIG. 7, but illustrating a modified form of the present invention.
Figure 9:
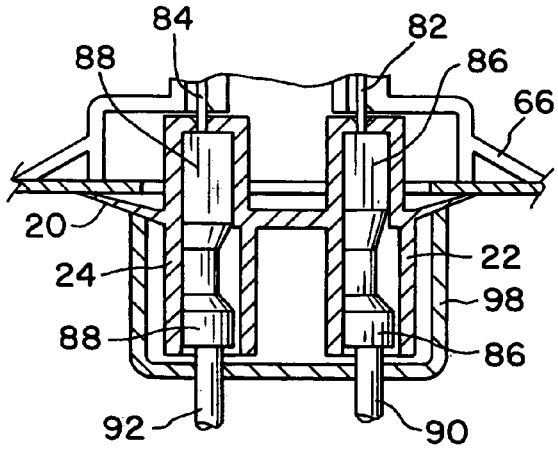
FIG. 9 is a fragmentary cross-sectional view similar to that of FIG. 8, but illustrating a still further embodiment of the present invention.

FIGS. 8 and 9 illustrate further embodiments of the present invention. In FIG. 8, rather than the use of potting material 94 in terminal bosses 22, 24 a shrink-fit sleeve 96 is provided over each terminal boss 22, 24 and wires 90, 92 therein. With the components properly positioned, heat is applied to shrink sleeves 96 to provide a moisture proof barrier and to firmly affix the positions of wires 90, 92 relative to bosses 22, 24.

FIG. 9 illustrates yet a further embodiment in which a snap-fit cap 98 is provided for closing the back of exterior component 12 with wires 90, 92 in terminal bosses 22, 24.

Figure 10:
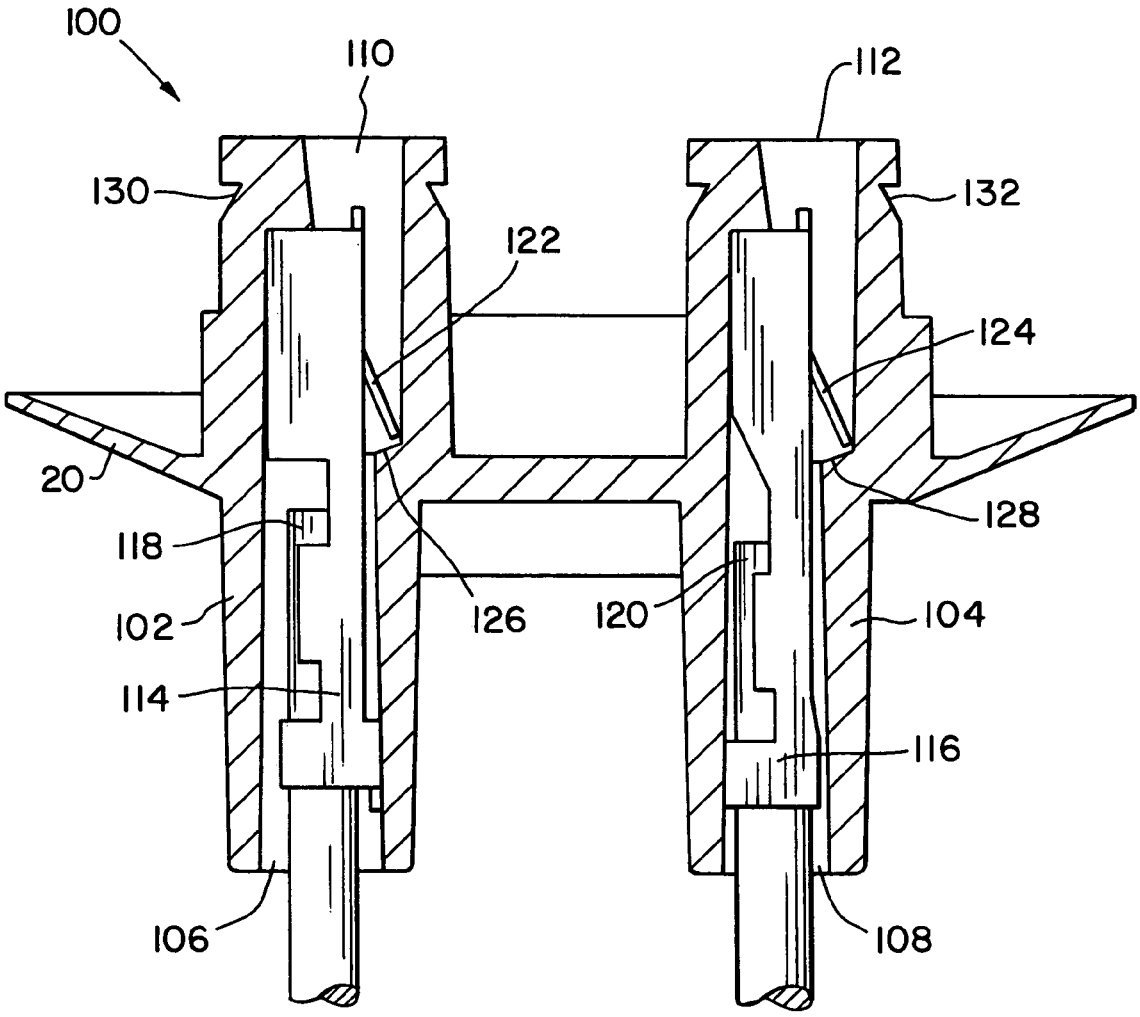
FIG. 10 is a cross-sectional view of another embodiment of the invention.

FIG. 10 illustrates yet another embodiment of an exterior component 100 having peripheral skirt 20 as described previously. Exterior component 100 defines first and second terminal bosses 102, 104 having rearward facing openings 106, 108 and forward facing openings 110, 112, respectively. Rearward facing openings 106, 108 are configured for receiving terminals 114, 116 electrically connected to wire ends 118, 120 of a wire harness for providing electrical current. Terminals 114, 116 are non-insulated terminals having locking tabs 122, 124, respectively that deflect when inserted through rearward openings 106, 108 and rebound to engage interior ledges 126, 128 within bosses 102, 104. Terminals 114, 116 are thereby secured within in bosses 102, 104, and are not easily pulled therefrom. Terminals 102, 104 can be further protected by the use of potting material 94, shrink sleeves 96, cap 98 or the like, as described previously.

Forward facing openings 110, 112 are sized and configured for receiving terminals from interior component 14, as described previously. To further protect against moisture infiltrating forward openings 110, 112 forward ends of bosses 102, 104 are provided with encircling troughs 130, 132 to capture moisture and direct it away from forward facing openings 110, 112.

Those skilled in the art will readily understand that terminal bosses 22, 24, 102, 104; female quick connect terminals 86, 88, 114, 116 disposed therein; terminal slots 74, 76 and male quick connect terminals 82, 84 associated therewith can be provided of different sizes and shapes such that only one type female terminal 86, 88, 114, 116 will fit in each terminal boss 22, 24, 102, 104 and the proper male terminal 82, 84 therefor will be provided in the proper terminal slot 74, 76. Accordingly, proper electrical connection is established through out assembly 10.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. An assembly for holding an electrical component in a wall having a hole, said assembly comprising:

a first component configured for attachment to the wall and to cover the hole on one side of the wall, said first component having a latch, said first component including a protuberance configured for mating engagement with a first notch in the wall to ensure proper alignment of said first component with the wall when positioning said first component with respect to the wall so as to be able to attach said first component to the wall and said protuberance being further configured for mating engagement with a second notch in the wall when said first component is securely attached to the wall;

a peripheral skirt surrounding said first component for engaging the wall and covering the hole on the one side of the wall;

a plurality of bosses in said first component for receiving first electrical terminals said bosses being open to an opposite side of the wall, and said bosses being situated on said first component such that said latch is positioned between said bosses;

a second component including a base configured for attachment to the first component and to cover the hole from a second side of the wall, said second component further including a plurality of terminal slots configured for holding second electrical terminals for electrically coupling with said first electrical terminals, said second component defining an aperture for receiving and engaging said latch for securing said second component to said first component, said base having baffles on opposite sides of said aperture such that said second electrical terminals are disposed outwardly of said baffles relative to said aperture such that each baffle is positioned between said aperture and an associated terminal slot; and a second component skirt for engaging the wall on a side opposite the side engaged by said skirt of said first component.

2. The assembly of claim 1, said base having a weep hole for conducting moisture away from said first electrical terminals and said second electrical terminals.

3. The assembly of claim 2, said weep hole in flow communication with a space between said baffles.

4. The assembly of claim 1, said latch including a tapered distal end and a lip for compressively securing said second component against the wall.

5. The assembly of claim 1, said first component having first and second terminal bosses with first electrical terminals therein, and wires leading from said female terminals out of said first and second terminal bosses.

6. The assembly of claim 5, said terminal bosses have a seal protecting said first electrical terminals, with said wires extending through said seal.

7. The assembly of claim 6, said seal including resin material in said bosses.

8. The assembly of claim 6, said seal including a shrink sleeve.

9. The assembly of claim 6, said seal being a cap.

10. The assembly of claim 1, said first component including a rotating lock configuration for attaching said first component to the wall.

11. The assembly of claim 1, each boss having an external trough for capturing and directing moisture.

12. The assembly of claim 1, each boss having a ledge for engaging each terminal.

* * * * *